340-566
1/18/83 XR 4,369,437 SR

United States Patent [19]

Thompson, Jr. et al.

[11] 4,369,437

[45] Jan. 18, 1983

[54] SECURITY AND ALARM APPARATUS

[76] Inventors: Robert E. Thompson, Jr., 15482 Foch Rd., Livonia, Mich. 48154; Leo D. Snedegar, 14055 Shadywood Dr., Plymouth, Mich. 48170

[21] Appl. No.: 244,202

[22] Filed: Mar. 16, 1981

[51] Int. Cl.[3] ..... G08B 13/08

[52] U.S. Cl. ..... 340/539; 340/547; 340/566; 340/568

[58] Field of Search ..... 340/524, 539, 545, 547, 340/566, 568, 572, 686, 689

[56] References Cited

U.S. PATENT DOCUMENTS 3,831,163 8/1974 Byers ..... 340/539

*Primary Examiner*—Alvin H. Waring
*Attorney, Agent, or Firm*—Charles W. Chandler

[57] ABSTRACT

A cover for a fill pipe opening of an underground fuel tank which contains a transmitter which will be activated when the cover is disturbed to transmit an alarm signal to a remote location. The signaling equipment is fully contained within the cover and the cover is sealed to protect the equipment from contamination. A rechargeable power source such as a battery is also contained within the cover, and it can be charged without breaking the sealed cover. The cover can be used in place of the existing cover without any modification to the fill line or fill access opening.

9 Claims, 12 Drawing Figures

SECURITY AND ALARM APPARATUS

TECHNICAL FIELD

This invention pertains to security devices which are capable of raising an alarm when physically disturbed or upon introduction of an object into a field of surveilance.

BACKGROUND OF THE INVENTION

1. Field of the Invention

There is an increasing need for devices to alert the police or other agencies to the entrance of an intruder or the disturbance of containers, covers, doors, etc. Some of these devices are designed to give an audible signal when there is a disturbance. Others are designed to transmit the information to a remote location without giving an indication at the sight that an alarm has been given. Sometimes a combination of local alarm signals and remote signals are given.

The increased cost of fuel supplies, and shortages, has increased the need for devices which will render fuel containers more secure. The cost of gasoline has risen to the point that thievery has increased. In the past such has been mainly confined to stealing of small quantities such as that which might fill a vehicle gas tank, but now larger quantities are being taken. Gasoline stations that are closed, such as on Sunday, or even for longer periods are particularly apt to be the subject of professional thieves. In the ground tanks at gas stations can contain substantial quantities of fuel. A tank truck can be easily driven into a station, the manhole cover removed, the fuel pipe opened and gasoline removed. It is normal to see a tank truck at gasoline stations. Ninety-nine percent of the time if they are delivering fuel. On the rarer occassions when a station is being permanently closed or new tanks are to be installed the trucks are used in removing fuel from the tanks. The average person seeing a tank truck parked at a gasoline station would normally assume that a delivery is being made. Even when a gas station is closed, and gasoline is being removed the average person would not likely assume that the removal was unauthorized.

The underground tanks are served by filler pipes covered by a manhole cover. The filler pipe extends downwardly from beneath the concrete or other surfacing of the station to the in ground tank. A cylindrical metal housing usually extends through the concrete or like surfacing to the filler pipe. The housing is closed by the manhole cover. The manhole cover simply rests in place in the housing. It is removed by prying upwardly.

The covers can readily be removed by almost anyone and therefore it's relatively easy to gain entrance to the underground tank fill pipes. With a proper length of hose and a pump, one could fill his tank truck readily from the underground supply.

It is thus desirable to provide some means for signaling when the manhole cover is removed.

2. Description of the Prior Art

It is known to provide alarm devices which will alert anyone near by to the possibility of unauthorized entry by an audible alarm. One such device is illustrated in U.S. Pat. No. 3,831,163 issued in 1974 to Byers. This device will detect tilting of a vehicle. Tilting might also occur when a manhole cover is removed to provide access to a filler pipe. The use of a radio transmitter and receiver is also mentioned in the Byers' Patent as a means of giving a signal at a remote location.

The inventor in U.S. Pat. No. 3,831,163 uses convex and concave conductive diaphrams bridged by a ball. The ball will move along one of the diaphrams if the unit is tilted and when it reaches a certain position it will bridge the space between the two diaphrams and an electrical circuit will be completed. In another form of the patented invention a conducting ring is provided between the diaphrams and the ball which will make contact with the ring when the device is tilted thus closing the circuit.

There are also many well known devices which will trigger an alarm upon entry into an area, or other disturbances such as breaking of glass, or the like.

SUMMARY OF THE INVENTION

The present invention pertains particularly to a signaling device for a tank for fluids such as gasoline chemicals, etc. It is designed to transmit a signal to a remote location. According to the invention, a self-contained alarm actuating system is provided within a manhole cover for the fill pipe opening. The cover is designed to cooperate with the filler pipe, metal housing in the same manner that an ordinary cover would, i.e., without changes in the housing or inlet sections of the tank fill pipe. The instant alarm simply takes the place of the existing cover. It can be in the form of the common cover which is simply dropped in place and removed by prying or lifting.

The device can be installed without modification of the equipment or tank, it is designed to protect and without modifying any other portion of the station or storage area.

The invention provides a tank alarm apparatus having a disc-like upper cover piece. The cover has a downwardly extending cylindrical section spaced inwardly from the periphery of the disc. The cylindrical section cooperates with the upper cover piece and lower cover piece to form an enclosed chamber. An alarm generating apparatus is mounted within the chamber thus formed. This apparatus comprises a magnetically influenced switch such as a reed switch which is normally held open by a magnetic field. There is further provided a radio frequency transmitter, and a power source for the transmitter. The power source, the transmitter, and the switch are connected so that the switch opens when the cover is disturbed. This results in the transmission of a radio frequency signal to a receiver. The receiver can be positioned in a gas station office, for example, and can in turn be connected to a police or alarm service circuit. Thus upon receipt of the signal from the cover the receiver will in turn transmit a signal to alert a more distant receiver that the cover has been disturbed.

The switch is maintained under the influence of a magnetic field provided either by a magnet supported within the chamber in the cover or positioned externally thereof. In the latter case the cover is provided with a locator means which cooperates with a mating element in the metal ring extension to ensure that the switch is properly positioned with respect to the magnet. It is within the contemplation of the invention to also provide a circuit opening device which is sensitive to tilting when the cover is tilted as well as when the magnetic field is disturbed. A renewable power supply such as a long life rechargeable battery is provided within the cover chamber. The cover thus does not require an electrical connection when in service.

Instead of a reed type switch a slide switch controlled by a magnet can be used.

Another feature of one form of the invention is the provision of adaptor means for adapting the cover to metal housing for varying sizes wherein the adaptor means may be used to support a magnet which cooperates with the reed-like switch or slide magnet. The invention provides a system and apparatus for equipping tanks with an alarm device which will render them much less likely to be the subject of thievery or contamination.

PREFERRED EMBODIMENT OF THE INVENTION

Figure 1:
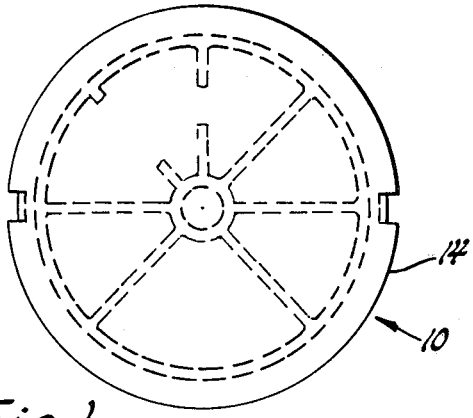
FIG. 1 is a top plan view of the cover containing the alarm apparatus.
Figure 4:
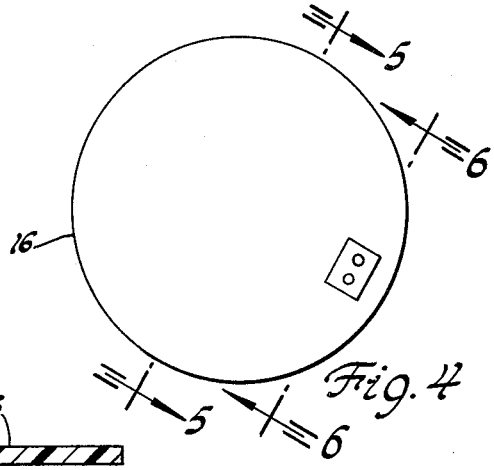
FIG. 4 is a bottom plan view of the bottom cover member .
Figure 5:
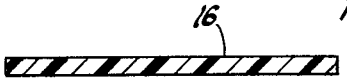
FIG. 5 is a sectional view taken along line 5—5 of FIG. 4.

Referring now to the figures in the drawings. The invention provides a cover for a fill pipe extension having an upper disc 10. A cylindrical section 12 which extends from the disc has a diameter less than the disc so that the disc provides an upper rim or ledge 14. The cylindrical section extends downwardly beneath the disc, and inturn cooperates with a bottom cover 16. The bottom cover together with the disc 10 and the cylindrical section 12 form a chamber in which is contained components of the alarm as described hereinafter.

Reinforcing ridges, such as 18, form a series of compartments 20, 22, 24, 26 and 28 within the cap.

The elements 10, 12 and 16 are preferably formed of a synthetic material such as the material sold under the trademark "Lexon".

Within the chamber provided by the cylindrical section 12, the reinforcing ridges are provided with cutouts such as 30, 32, 34, 36 and 38, which make it possible to pass wire leads between one chamber and the other.

Within the compartment 20 there is provided a reed switch 40 such as the type 4FR proximity switch manufactured by the Honeywell Company. This switch is a normally open dry reed switch located between two identical permanent magnets. The magnetic field normally maintains the switch in a open position. When the field is disturbed however, such as by close proximity to the iron housing when the cover is placed in the housing this switch will close.

Figure 7:
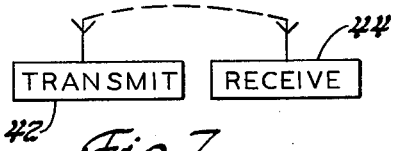
FIG. 7 is a schematic representation of the transmission and receiving arrangement.

Within compartment 28, there is positioned a transmitter 42. This is a transmitter of radio frequency signals and is adapted to cooperate with a receiver such as 44, see FIG. 7. A suitable receiver is model D67 Linear Alert Digital Security Receiver, manufactured by the Linear Corporation of Englewood, California and which can be obtained with a suitable transmitter also provided by the Linear Corporation, having digital coding keys for coding the transmitter and receiver to a particular code suitable for the installation.

There is also provided within compartment 26 a battery 46, preferably a high retention nickle cadmium battery, such as available from the General Electic Company, and which is rechargeable. The battery transmitter and reed switch are all that is needed to provide an alarm device contemplated by the invention when coupled with a suitable receiver. However, it may be also desirable to provide in certain cases a device which is sensitive to tilting such as a mercury tilt switch 48 positioned in compartment 22.

Suitable wire leads such as 52 and 54 are provided within the compartment to interconnect the various components.

The bottom cover 16 has an electrical socket 50 adapted to be connected to a plug. The socket is connected to the leads 52 and 54 extending to the battery. When the components are positioned in their respective compartments, the leads 52 and 54 can be sodered to the terminals of the socket 50, and the bottom cover can then be put into position and sealed against the cylindrical section 12 to form a sealed enclosure for the components. Electrical energy can be supplied to the battery from time to time by connecting to a plug associated with a suitable electrical source.

As will be readily understood from a viewing of the drawings the cover is adapted to be positioned with the rim of the disc bearing upon the upper lip of a tube, or pipe, or housing for a filler pipe for an underground storage tank.

Suitable slots 56 and 58 are provided in the rim for receiving a pry bar to facilitate removal of the cover in order to gain access to the filler pipe.

Figure 8:
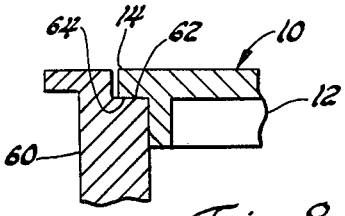
FIG. 8 is a fragmentary sectional elevation showing a filler pipe metal housing and an alarm apparatus in association therewith.

The typical sunken tank at a gas station has a filler pipe which extends to approximately the level of the bottom of the concrete pavement in the service area. Around this there is a cylindrical metal housing or rim which surrounds the upper end of the filler pipe and extends thereabove while the concrete is being poured. This extends the access opening to the filler pipe to the top of the pavement. It is such a housing 60, (see FIG. 8), which has a seat 62 for the lip 64 of rim 14 of the disc 10. When it is desirable to remove the cover it is simply necessary to insert a pry bar in one of the openings 56 or 58 and pry the cover upwardly. With the unit in place and the receiver functioning, it is apparent that when the cover is removed from the proximity of the iron ring the reed switch will open and the transmitter will start transmitting. This signal will be received by the receiver, which can be positioned in the station office, and which can be connected to a police or security service alarm circuit, resulting in alerting that the cover is being removed.

The sizes of the metal rings (housings) vary. For this reason an adapter ring such as 66 of FIGS. 9 and 11 can be provided. Ring 66 has a lip 68 which rests on seat 69 of housing 70, with the lip 14 of the disc 10 resting in turn on rim 72 of adapter 66. Thus a single cover can be fitted to several sizes of rings through use of appropriately sized adapter rings.

Figure 2:
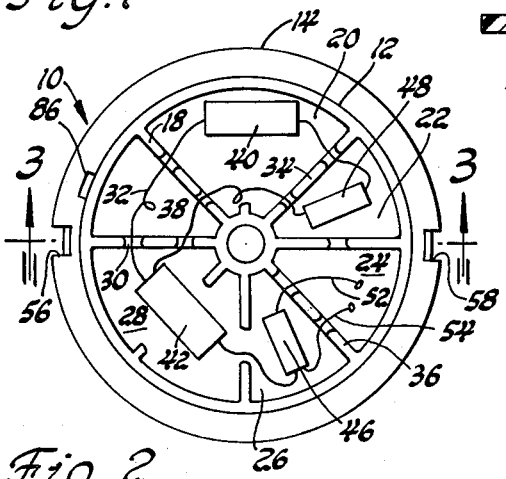
FIG. 2 is a bottom plan view with a bottom cover member removed showing the interior of the cover.
Figure 9:
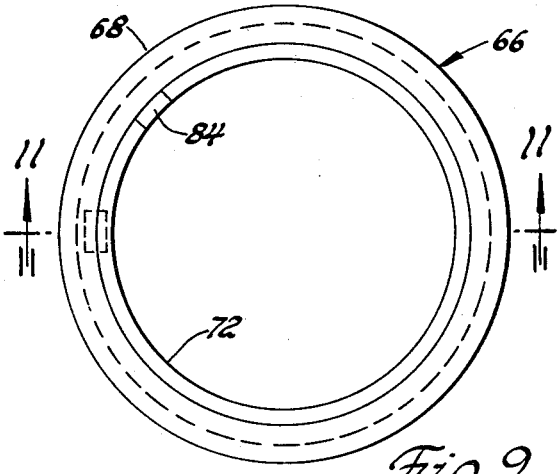
FIG. 9 is a top plan view of an adapter ring.
Figure 10:
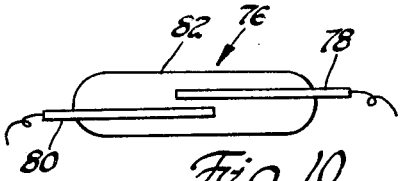
FIG. 10 is a plan view of a reed switch.
Figure 11:
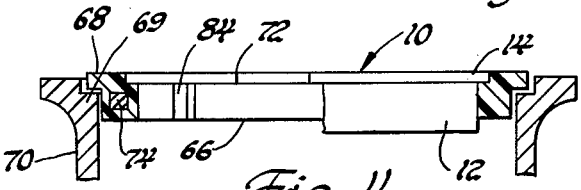
FIG. 11 is a, partly sectional, elevation, partly taking along line 11—11 of FIG. 9, showing an alarm apparatus in position in the adapter ring of FIG. 9, with the latter positioned in the filler pipe metal housing and illustration a second preferred form of the invention.

FIGS. 9 and 11 taken together with FIG. 2 also show an alternative form of the invention in which one of the magnetic means for holding the switch open is positioned within the auxilliary ring 66. In this case the ring 66, which can be made of plastic such as Lexon, mentioned above, is provided with an embedded magnet 74. The embedded magnet serves to maintain a reed switch such as 76, FIG. 10, in the closed position. However, when the cover is removed the magnetic field is altered and the switch will open.

The magnet reed switch 76 has a pair of reeds 78 and 80 which are mounted in the glass enclosure 82 and is commercially available. The switch 76 is adapted to be positioned in the cover 10 instead of the switch 40 and functions in the same manner. However, in this instance the magnet which is necessary to retain the switch 76 in a closed position is the magnet 74 positioned within the ring 66. The ring 66 has a slot 84 and the cap 10 has a projection 86 adapted to be received within the slot 84, (FIG. 2). By this means the cover is properly positioned with respect to the magnet 74 shown in FIG. 11, to maintain the switch in a closed condition as long as the cover remains in place.

The ring 66 can thus perform two purposes: (1) it can adapt a cover such as shown in FIG. 1 to a ring (housing) such as 70 where the latter is larger than the cover and/or; (2) the ring 66 can serve to provide the magnetic field for the reed-type or other switch.

Figure 12:
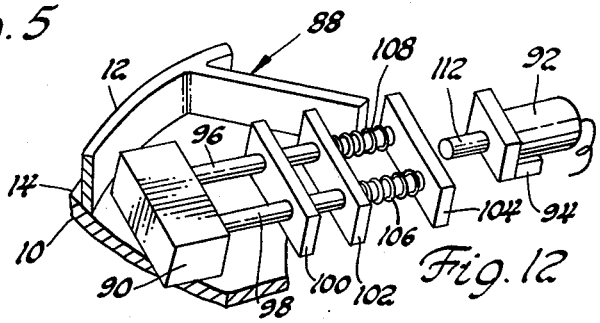
FIG. 12 is a perspective view of a slide switch.
Figure 3:
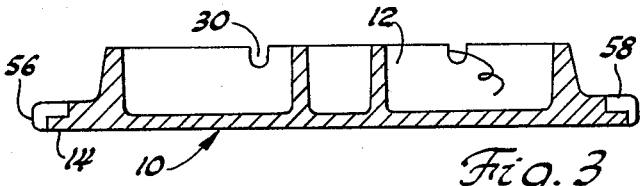
FIG. 3 is a sectional elevational view taken along line 3—3 of FIG. 2.
Figure 6:
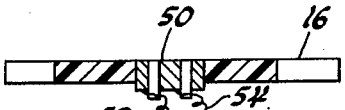
FIG. 6 is a sectional view taken along line 6—6 of FIG. 4.

FIG. 12 shows a slide switch 88 that can be used in place of the reed switch 40 or the switch 76. The slide switch comprises a magnet 90 and a normally closed button switch 92.

The button switch can be adhered to disc 10 directly, or through base plate 94, by welding or adhesive.

A pair of actuating rods 96 and 98 are slidably received in plastic guides 100 and 102 also secured to disc 10 by welding or adhesive. Rods 96 and 98 are fixedly connected to magnet 90 and to actuating plate 104. A pair of coiled springs 106 and 108 on rods 96 and 98 urge the actuating plate 104 and magnet 90 to the right, as viewed in FIG. 12. The normally closed button switch 92 has a button 112 and is secured to disc 10 in position to open the switch when actuating plate 104 moves to the right. The slide switch is positioned in the cover so that when the cover is received in ferromagnetic housings 60 or 70, the magnet 90 will move actuating plate 104 to the left, enabling switch 92 to close.

The bottom cover is secured to the cylinder by adhesive of a suitable kind or ultrasonic welding. The components comprising the transmitter, reed or other switch, the battery and the mercury switch are also adhered to the top cover by similar means. The top cover and the cylindrical section are preferably molded in a single piece. This results in a sealed chamber impervious to air and water and other fluids. The ring 66 when used, is permanently affixed to housing 70 by a commercially available adhesive.

The transmitter 42 is a digital coded unit which can transmit in chanels between 295 and 325 MH2, and is available from the Linear Corporation. When coupled with the Linear Receiver described above over three-thousand frequencies are available. Even when stations are very close to each other they can be easily provided with non-conflicting codes.

The circuit including the mercury switch 48 and the magnetic switch, such as 40, is normally closed when the cover is in place, and the transmitter will start to transmit upon any interruption, such as caused by tilting of the cover. However, the current drain is very low and charging should infrequently be necessary.

It will be apparent that the magnetic switches are adapted to be operated upon changes in the magnetic fields of their respective magnets. They are maintained in a first condition or position by the field of their respective magnets, but urged toward, and will assume, a second position or condition when the influence of the field is changed. The housings 60 and 70 can be of non-ferromagnetic material when a ring 66 having a magnet 74 is used.

While I have shown and described preferred forms of our invention, it will be understood that other forms and variations can be devised within the scope of the invention and that accordingly the invention is to be limited only to the claims appended hereto.

We claim:

1. A fill pipe alarm apparatus comprising:

a cover comprising a disc;

a cylindrical section of a diameter less than said disc connected to and extending downwardly from said disc to form a rim section on said disc and a chamber extending below said disc;

a bottom cover secured to said cylindrical section and forming therewith and with said disc a sealed chamber;

a switch within said chamber adapted to be maintained in a first condition by a magnetic field but urged toward a second condition upon a change in said field;

a signal transmitter;

an electrical power source;

means supporting said switch, said transmitter, and said power source within said chamber;

said switch, said power source and said transmitter being in electrical connection such that when said switch assumes a second condition a signal will be transmitted by said transmitter; and means for maintaining said switch under the influence of a selected magnetic field to normally maintain said switch in said first position whereby upon changing of the influence of said field, said switch will assume said second condition and effect the transmission of a signal by said transmitter.

2. The alarm enclosure of claim 1, wherein:

said means for maintaining said switch under influence of a magnetic field comprises a magnet supported within said chamber and positioned such that the field of said magnet will be altered sufficiently to cause operation of said switch from one of said conditions to the other when said magnet closely approaches a ferromagnetic material.

3. The alarm apparatus of claim 1, wherein:

said power source comprises a battery, and there are means for charging said battery comprising an electrical connection secured thereto.

4. The alarm apparatus of claim 1, wherein:

said means for maintaining said switch under a magnetic field comprises a magnet mounted externally of said cover.

5. The alarm apparatus of claim 4, wherein:

said magnet is mounted in a ring-like member;

said ring-like member is adapted to be mounted on a housing adapted to be closed by said cover;

said cover is adapted to be supported on said ring-like member; and there are locator means for ensuring relationship of said cover with said ring-like means such that the proper magnetic field effect is achieved upon said switch by said latter magnet.

6. The alarm apparatus of claim 4, wherein:

there is provided means for positioning said magnet in alignment with said switch.

7. The alarm apparatus of claim 6, wherein:

the latter means comprises a groove and a mating lip.

8. The alarm apparatus of claim 1, including:

a circuit opening device in association with said transmitter which is normally closed when in horizontal position but which will open when tilted.

9. The alarm apparatus of claim 8, wherein:

the latter device comprises a mercury switch.

* * * * *